US006478577B1

(12) United States Patent
Maricic et al.

(10) Patent No.: US 6,478,577 B1
(45) Date of Patent: Nov. 12, 2002

(54) BURNER NOZZLE WITH CURVED HEAD

(75) Inventors: Richard Maricic, Parma, OH (US); Thomas F. Hutchinson, Jr., Lorain, OH (US)

(73) Assignee: Beckett Gas, Inc., North Ridgeville, OH (US)

( * ) Notice: Subject to any disclaimer, the term of this patent is extended or adjusted under 35 U.S.C. 154(b) by 0 days.

(21) Appl. No.: 09/645,701

(22) Filed: Aug. 24, 2000

(51) Int. Cl.[7] ..... F23D 14/04
(52) U.S. Cl. ..... 431/353; 239/552; 239/559
(58) Field of Search ..... 431/286, 353, 431/354; 239/434, 552, 559, 560, 561, 567, 548, 556, 558

(56) References Cited

U.S. PATENT DOCUMENTS

| | | | | | |
|---|---|---|---|---|---|
| 56,949 | A | * | 8/1866 | Jones et al. | 239/567 |
| 196,055 | A | * | 10/1877 | Talcott | |
| 850,007 | A | * | 4/1907 | Huntoon | |
| 909,654 | A | * | 1/1909 | Oliver | |
| 1,206,037 | A | * | 11/1916 | Seamans | |
| 1,233,779 | A | * | 7/1917 | Hicks | 431/353 |
| 1,601,751 | A | * | 10/1926 | Wills | |
| 1,644,505 | A | * | 10/1927 | Beckett | 431/353 |
| 1,955,512 | A | * | 4/1934 | Paulucci | 239/552 |
| 2,462,704 | A | * | 2/1949 | Zink | 239/560 |
| 2,828,604 | A | * | 4/1958 | Hirsch et al. | |
| 2,895,688 | A | * | 7/1959 | Seiberling et al. | |
| 3,001,533 | A | * | 9/1961 | Holdren | |
| 3,333,773 | A | * | 8/1967 | Hutchinson | 239/556 |
| 3,439,997 | A | * | 4/1969 | Hancock et al. | 239/556 |
| 3,630,649 | A | * | 12/1971 | Hancock et al. | 431/353 |
| 4,485,972 | A | * | 12/1984 | Freber | 431/354 |
| 4,626,196 | A | * | 12/1986 | Stohrer, Jr. | 431/264 |
| 5,186,620 | A | * | 2/1993 | Hollingshead | |
| 5,328,357 | A | * | 7/1994 | Riehl | 431/354 |
| 5,839,891 | A | * | 11/1998 | Cook | |
| 6,093,018 | A | * | 7/2000 | Avshalumov | 431/353 |

FOREIGN PATENT DOCUMENTS

| | | | | |
|---|---|---|---|---|
| GB | 142759 | * | 5/1920 | 239/559 |
| GB | 374590 | * | 6/1932 | 239/559 |

* cited by examiner

*Primary Examiner*—Sara Clarke
(74) *Attorney, Agent, or Firm*—Watts, Hoffmann, Fisher & Heinke Co.

(57) ABSTRACT

A burner nozzle includes a burner tube that extends along a central axis and has an inlet end portion for receiving combustible gas and air. The burner tube extends along the central axis from the inlet end portion to an outlet end portion for releasing a mixture of gas and air. A curved head with a plurality of openings and an imperforate portion is connected to the outlet end portion. The openings and imperforate portion of the curved head create a transverse flow of gas and air out of the curved head to produce a shaped flame. A burner assembly may include a combustion tube in which the burner nozzle is disposed and connected. The burner nozzle is used in a method of widening and shaping a flame.

21 Claims, 3 Drawing Sheets

BURNER NOZZLE WITH CURVED HEAD

FIELD OF INVENTION

This invention relates to burners and, more specifically, to gas burners suitable for use in appliances and the like.

BACKGROUND OF THE INVENTION

Burners are used, for example, in apparatuses including furnaces and appliances such as clothes dryers. A principle component of burners is a nozzle typically in the form of a venturi tube. Combustible gas is fed into the nozzle and entrains air into the nozzle. The air and gas is mixed in the venturi and the mixture emerges from the outlet end. An igniter may be attached directly to the venturi tube in front of the outlet opening in alignment with a longitudinal axis along which the nozzle extends and ignites the mixture as it leaves the outlet, thereby creating flame which produces heat that is utilized by the apparatus.

In furnaces, a plurality of burner nozzles are typically arranged side-by-side and are designed for cross-ignition of the gas in adjacent nozzles. One conventional nozzle has two plenum chambers located at an outlet end of the venturi tube. Each plenum chamber has a thin outlet slit along its side edges. Flame released from the side outlet slits of one nozzle ignites gas from an adjacent nozzle.

Clothes dryer burners are horizontally fired into ducts of the dryer. The ducts shield the open flame and force the heated gases in the desired direction. The burner may include an attachment known as a flame spreader which is separately formed from the nozzle, mounted such as by welding to the nozzle and axially spaced from the outlet opening of the nozzle. One function of a flame spreader is to prevent upward lifting or curling of the flame as it travels horizontally. The flame spreaders are disposed in the flame and thus, are exposed to relatively high temperatures. This requires the flame spreaders to be fabricated from metals or coated with materials which can withstand this high temperature environment.

Conventional gas dryer burner nozzles typically produce flame having a length of, for example, about one foot. However, space is limited in the dryer. Long flame lengths may result in inefficient heat transfer between the flame and air inside the duct work, overheating of the duct work, or an increase in the cost of the dryer due to the use of enough duct work to accommodate the long flame. Heated gases from the horizontal flame are typically directed through a 90° elbow, generally vertically to another 90° elbow, through a screen and then into a rotatable drum in which clothes are dried.

Typical gas dryer burner nozzles can be difficult and relatively expensive to manufacture. Such burner nozzles are fabricated by a practice of forming a venturi tube from tubing and welding a stamped flame spreader to an end of the formed burner tube.

SUMMARY OF THE INVENTION

The present invention is directed to a burner nozzle for producing a shaped and/or shortened flame for efficient heat transfer. The burner is characterized by a curved head with an imperforate portion for shaping the flame. The burner is particularly well suited for use in clothes dryers where a flame that is spread out transverse to the direction of gas flow and that has a reduced length, is desired. A burner nozzle produced in accordance with the present invention reduces the fabrication costs and results in efficient heat transfer.

In general, the invention is a burner nozzle that includes a burner tube that extends along a central axis and has an inlet end portion for receiving combustible gas and air and an outlet end portion for releasing a mixture of the gas and air. A main gas flow passage extends along the central axis between the inlet end portion and the outlet end portion. A curved head that has a plurality of openings is connected to the outlet end portion. The curved head includes an imperforate portion that is disposed near the central axis. The plurality of openings and imperforate portion of the curved head create a transverse flow of the mixture of gas and air out of the curved head to produce a shaped flame that results in efficient heat transfer between the flame and air inside a heat-receiving member, such a duct, located downstream of the outlet end.

As to the specific features of the burner nozzle, the burner tube may include wing portions that extend laterally from the burner tube for attachment to the duct of a dryer. The curved head may comprise a curved portion defined by a portion of a sphere, a cylindrical portion that extends from said curved portion and a mounting flange that extends transversely from said cylindrical portion.

The curved head may be hemispherical in shape with round openings evenly spaced about the circumference of the curved head. The plurality of openings in the curved head may be arranged in two rows. The holes of the first row are circumferentially spaced around the head near a base of the head. The holes of the second row are circumferentially spaced around the head between the first row of openings and a tip of the burner located at the central axis. The openings of the first row near the base of the curved head may be larger than the openings of the second row that are between the first row and the tip. The head may also include a central opening at the tip, along the central axis.

A burner assembly may be formed by fastening the inventive burner nozzle in the interior of a combustion tube. The combustion tube may be comprised of two articles formed of stamped metal or a single rolled form. Preferably, in the case of a clothes dryer application, only a single burner nozzle is used in the burner assembly. The heat receiving member or duct comprises a passageway having a portion with a shape (e.g., circular) that corresponds to the elongated shape of the flame.

A portion of the mixture of gas and air may be passed through an opening in the head that encompasses the central axis. The diameter of the opening that encompasses the central axis can be varied to elongate or shorten the length of the flame.

A general method of producing a shaped flame from a burner nozzle comprises directing combustible gas and air into an inlet end portion of a burner tube that extends along a central axis. The gas and air are mixed in the burner tube. The gas and air are directed along the central axis toward and outlet end portion of the burner. A portion of the gas and air are diverted by an imperforate portion of a curved shaped head at the outlet end portion away from the central axis. The gas and air are passed through circumferentially spaced openings in the curved head. The mixture is ignited to produce a shaped flame. When the gas and air are passed through the circumferentially spaced openings, the head may direct a portion of the gas and air in a direction that is transverse to the central axis.

The present invention offers numerous advantages over prior gas dryer burners. The imperforate portion in conjunction with the openings in the curved head enable elongation of the flame transverse to the central axis of the burner nozzle. This results in a flame that has an ideal shape when used with duct work having a corresponding passageway (e.g., a circular duct). There is an efficient heat transfer between the elongated transverse flame and the air in the duct since there is less wasted space compared to the use of a burner that produces a flame with a small diameter in a duct that has a large diameter. Alternatively, or in addition to the flame shaping feature, the burner nozzle may produce a shortened flame having a length of, for example, about one half of conventional burner nozzles used in clothes dryers. In vertical firing applications there is a shorter distance between the end of the flame and the entry to the drum than in horizontal firing applications. Therefore, a flame that is too long may overheat the duct work, the screen or articles in the dryer.

Other embodiments of the invention are contemplated to provide particular features and structural variance of the basic elements. The specific embodiments referred to, as well as possible variations in the various features and advantages of the invention, will become better understood from the accompanying drawings together with the detailed description that follows.

DETAILED DESCRIPTION OF PREFERRED EMBODIMENTS

Figure 1:
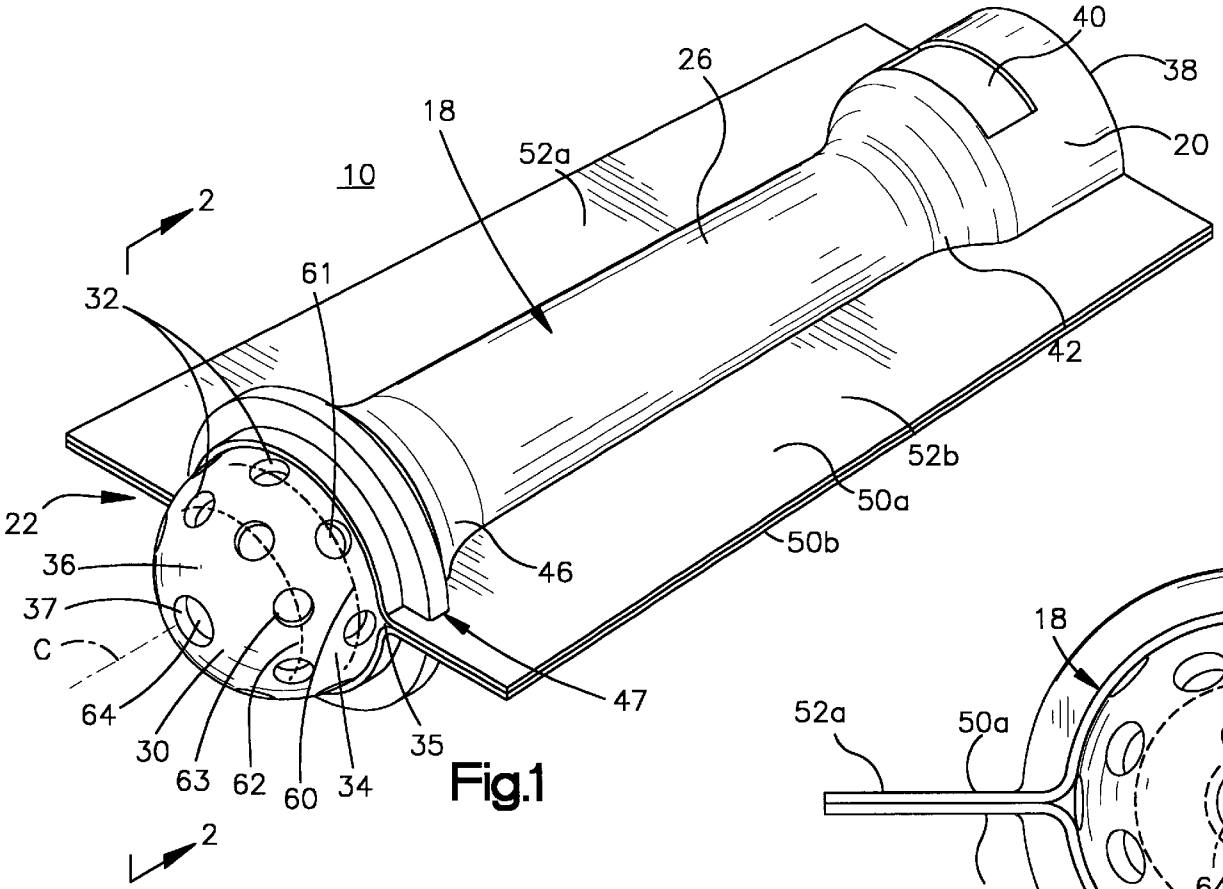
FIG. 1 is a perspective view of a gas burner nozzle constructed in accordance with the present invention.
Figure 4:
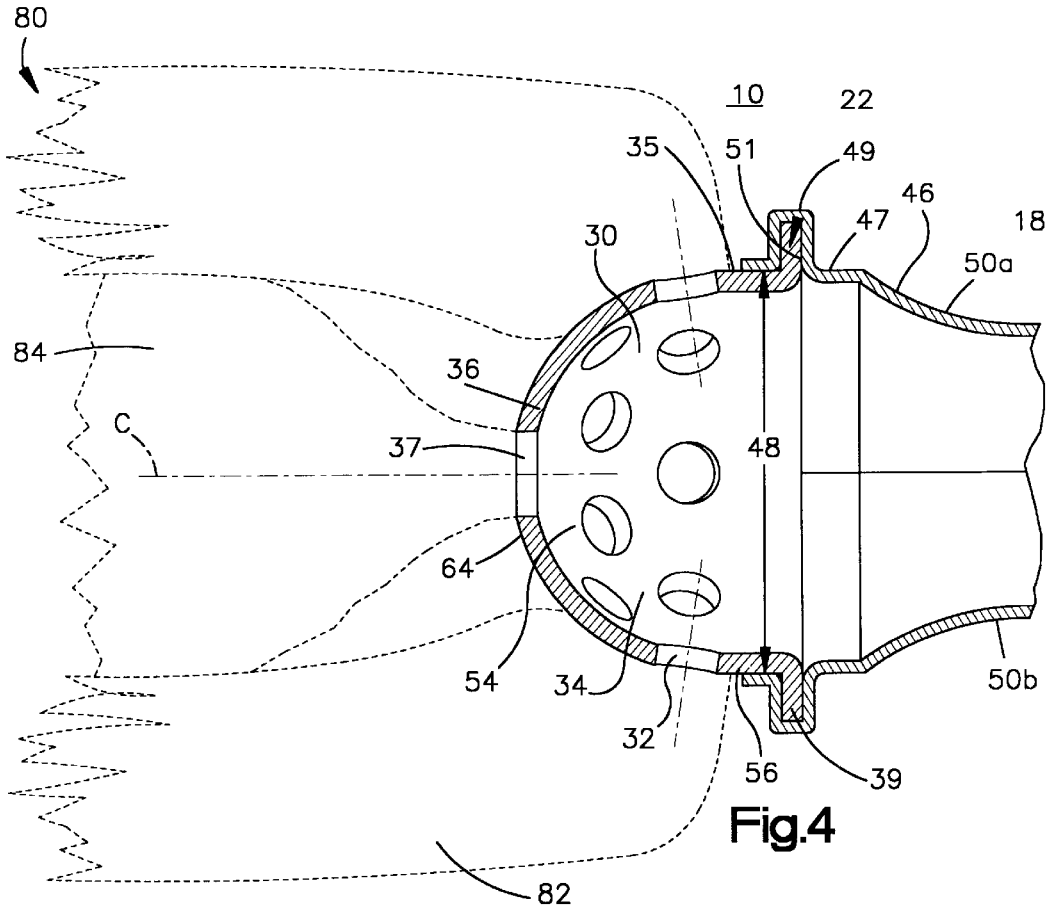
FIG. 4 is a cross-sectional view as seen along the plane represented by line 4—4 in FIG. 3; and, FIG. 5 is a perspective view of a gas burner assembly constructed in accordance with one of the embodiments of the present invention.

Referring now to the drawings and to FIG. 1, in particular, one embodiment of a burner nozzle constructed in accordance with the present invention is designated generally by the reference numeral 10. The burner nozzle 10 includes a burner tube 18 that extends along a central axis C. The burner nozzle 10 has an inlet end portion 20 for receiving combustible gas and air and an outlet end portion 22 for releasing a mixture of the gas and air. A main gas flow passageway 26 extends along the central axis between the inlet end portion 20 and the outlet end portion 22. A heat receiving member (not shown), such as a duct leading to a drum of a clothes dryer is disposed downstream of the outlet end portion 22 relative to a direction of flow of the mixture of gas and air. A curved head 30 is connected to the outlet end portion 47 of the tube 18. The curved head has a plurality of openings 32 spaced around its circumference 34 near a base 35 of the curved head 30 and an imperforate portion 36 that extends from the plurality of openings 32 nearly to a tip 64 of the curved head 30. The imperforate portion 36 creates a transverse flow of the mixture of gas and air out of the plurality of openings 32 to produce a shaped flame. In the exemplary embodiment, the curved head includes an optional central hole 37. The size of the central hole 37 dictates flame length and width. Referring to FIG. 4, the curved head also includes a mounting flange 39 that extends around the base 35 of the curved head 30.

Figure 3:
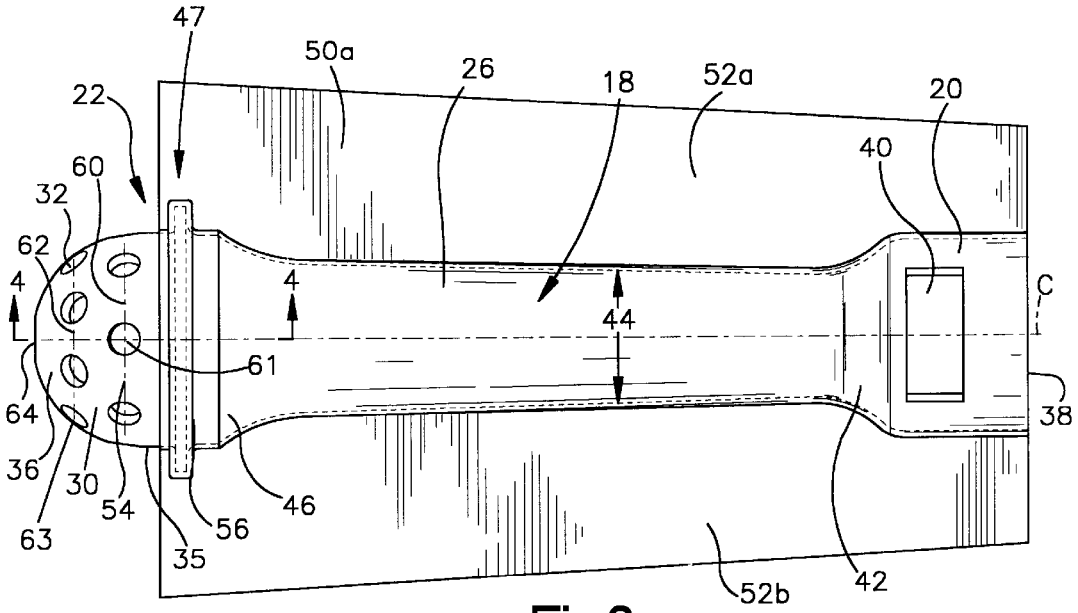
FIG. 3 is a top plan view of a burner nozzle constructed in accordance with the present invention.

Referring to FIGS. 1 and 3, a gas supply opening 38 at the inlet end portion 20 of the burner tube 18 is sized so that the burner tube may be connected in a conventional manner to a gas valve (not shown). The term "gas" is used herein in reference to a combustible fuel in gaseous form. It will be appreciated that any suitable gaseous combustible fuel may be used. For example, natural gas, propane, butane, and other gas mixtures may be suitable gaseous fuels. Air supply openings 40 are formed at the inlet end portion of the burner tube. Those skilled in the art would appreciate, in view of this disclosure, that the size of the air supply openings may be adjusted as desired to be fixed upon fabrication or may be variable using a shutter, depending upon the air flow requirements of the particular application. As the gas flows by the air supply openings it entrains the air into the burner tube.

Referring to FIGS. 1 and 3, the main passageway 26 has a shape that forms a venturi in a well known manner. The burner tube 18 includes a first transition 42, where the diameter of the gas supply opening is gradually reduced to the inner diameter 44 (shown in FIG. 3) of the burner tube 18. The main gas flow passageway 26 extends from the first transition 42 to a second transition 46, where the inner diameter of the burner tube 18 gradually increases to the large inner diameter 48 (shown in FIG. 4) of the outlet portion 47 of the burner tube. Referring to FIG. 4, a head mounting portion 49 is defined around the circumference of the outlet portion 47 of the burner tube. The head mounting portion 49 defines a narrow cavity 51 in the outlet portion 47 that has a diameter that is larger than the diameter 48 of the rest of the burner tube 18. The cavity 51 of the head mounting portion 49 is sized to accept the mounting flange 39 of the head 30.

The burner tube 18 may be fabricated from two sheet metal halves 50*a*, 50*b* or from one single sheet. In the preferred embodiment, the two halves 50*a*, 50*b* are mirror images of one another. The wing-shaped members 52*a*, 52*b* are preferably formed integrally with and flank the burner tube 18. This facilitates cost effective fabrication since the same die is used to fabricate each sheet metal half. The first step is to size each sheet metal half for the appropriate height and width. The air supply openings in the inlet end portion are formed in each sheet metal half. The sheet is then stamped and die configured to form integral "half sections", each containing the features of the burner tube 18. The two sheet metal halves are then joined together and form a gas tight seam.

Figure 2:
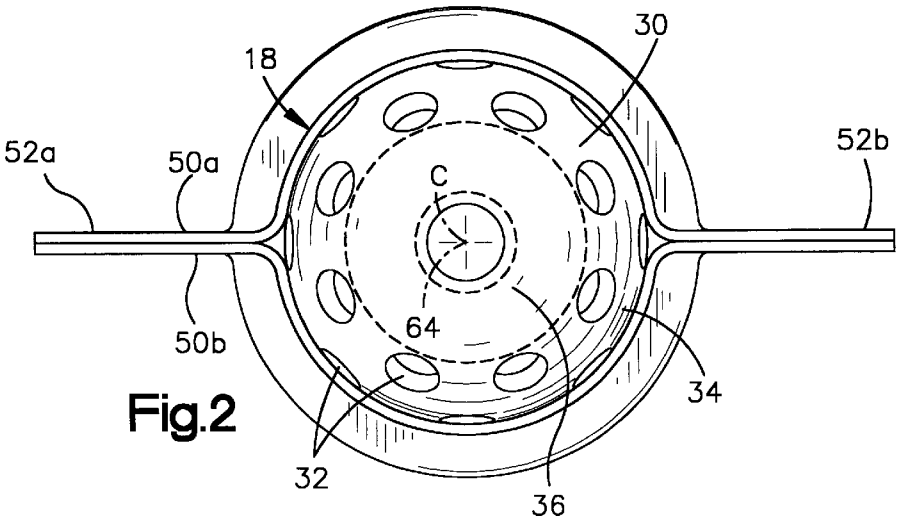
FIG. 2 is a front elevational view of the gas burner nozzle shown in FIG. 1.
Figure 5:
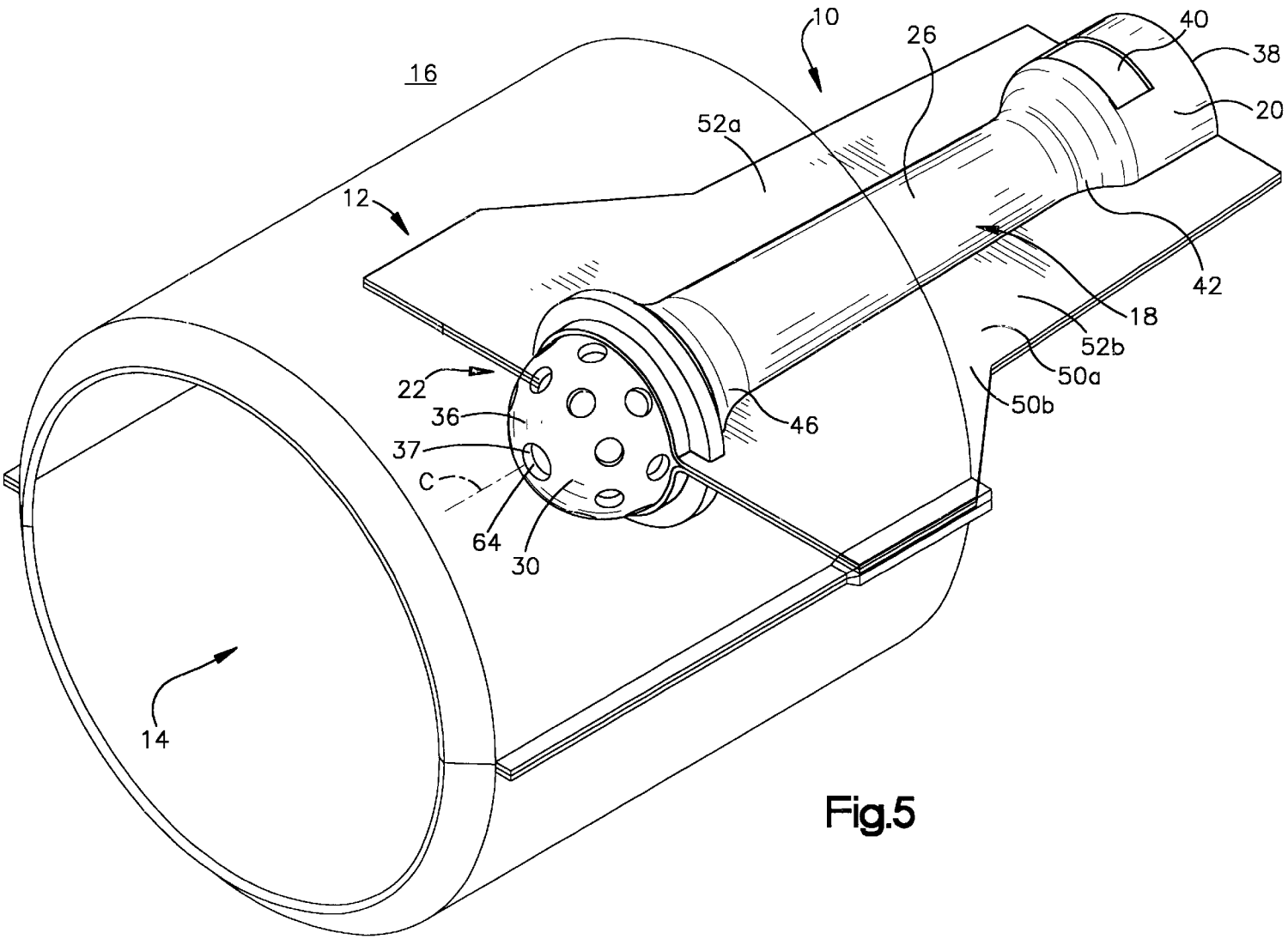

Referring to FIGS. 1, 2 and 4, the burner tube 18 may be formed from two stamped sheet metal halves 50*a*, 50*b*. The sheet metal halves 50*a*, 50*b* each include wings 52*a*, 52*b* that are spot welded or mechanically fastened together to form the burner tube 18. In one embodiment, BTM Company's Tog-L-Loc sheetmetal joining system is used to fasten the sheetmetal halves 50*a*, 50*b* together to form the burner tube 18. The wings 52*a*, 52*b* are formed integrally with the burner tube and extend outwardly from the main gas flow passageway 26. The wings 52*a*, 52*b* may be used to mount the burner nozzle 10 to an optional outer combustion tube 12, as shown in FIG. 5. Although the sheet metal halves can be constructed to form a cavity in each of the wings 52*a*, 52*b* that has an opening near the head for a portion of the mixture of gas and air to exit, none of the mixture of gas and air is permitted to exit through the wings 52*a*, 52*b* in the exemplary embodiment.

Referring to FIG. 4, the curved head 30 of the exemplary embodiment includes a hemispherical portion 54, a cylindrical portion 56 that extends from the hemispherical portion, and a mounting flange 39 that extends transversely from the cylindrical portion 56 around the circumference of the cylindrical portion 56. The outer diameter of the cylindrical portion 56 is sized to fit within the inner diameter 48 of the outlet end portion 22 of the burner tube 18. The curved head 30 is installed in a sheet metal half 50*a* of the burner tube 18, with a portion of the mounting flange 39 of the head 30 disposed in the cavity 51 in the tube sheet metal half 50*a*. The mounting cavity 51 in the second sheet metal tube half 50*b* is placed over the exposed portion of the mounting flange 39. The first and second sheet metal halves 50*a*, 50*b* are then secured together to capture the mounting flange 39 in the mounting cavity 51 between the first and second halves. In the exemplary embodiment, the cylindrical portion 56 of the head 30 is disposed within the burner tube 18 and the hemispherical portion 54 of the head 30 extends out of the burner tube 18.

The hemispherical portion 54 of the head 30 includes a plurality of openings 32 about the circumference 34 of the head 30 near the base 35 of the head. Referring to FIGS. 1 and 3, the plurality of openings 32 is comprised of a row 60 of large round openings 61, evenly spaced around the head 30 near the base 35 of the head 30 and a row 62 of smaller round openings 63 evenly spaced around the head 30 between the row 60 of large openings 61 and a tip 64 of the head 30. In the exemplary embodiment, each of the openings 32 of the curved head 30 are round. The round openings 32 in the head are created by punching appropriately shaped holes in a flat piece of stock that become substantially round when the flat piece of stock is formed into a curved head. The punched openings become round as the flat piece of stock is formed into a curved head. It should also be readily apparent to those skilled in the art that the openings 32 can be drilled in the curved head 30 after the flat piece of stock is formed into a curved head.

The imperforate portion 36 of the head is defined by the area of the hemispherical portion 54 of the curved head 30 between the row 62 of small round openings 63 and the central hole 37 in the tip 64 of the head (shown by dotted lines in FIG. 2) or from the row 62 up to and including the tip 64 at axis C, if no hole 37 is used. The imperforate portion 36 inhibits a portion of the mixture of gas and air from exiting the burner nozzle along the central axis C and directs a portion of the mixture of gas and air out the plurality of openings 32 in a direction transverse to the central axis C of the burner nozzle 10 to produce a shaped flame. The shape of the flame can be modified by modifying the size of the central hole 37. Increasing the size of the central hole 37 increases the length of the flame and decreases the diameter of the flame. Decreasing the size of the central hole 37 decreases the length of the flame and increases the diameter of the flame. The central hole 37 can be eliminated to produce a short flame that has a wide diameter. The size, shape and pattern of the plurality of holes 32 about the circumference 34 of the head can also be adjusted to adjust the shape of the flame produced by the burner. For example, the holes of the second row can be larger than the holes of the first row or the plurality of holes 32 can be arranged in a non-circular pattern.

Referring to FIG. 5, the burner 10 of the present invention may optionally be connected to an outer combustion tube 12 to form a burner assembly 16. The outer combustion tube 12 surrounds an interior region 14 in which a burner nozzle 10 is disposed. The burner assembly 16, as shown in FIG. 5, is suitable for use with both horizontal and vertical flow of the mixture of gas and air. The burner nozzle 10 of invention is designed to be used in vertical and horizontal firing where the combustion tube 12 and duct (not shown) have a circular shape. A short combustion tube and duct having a large diameter is accommodated by a burner tube having a small central hole 37 or no central hole, since the flame produced is short and wide. A longer combustion tube and duct having a smaller diameter is accommodated by a burner tube having a larger central hole, since the flame produced is longer and narrower.

When a combustion tube 12 is used, it may be formed of galvanized or aluminized steel. The curved head 30 may be formed of any suitable material, such as aluminized or stainless steel. The combustion tube 12 is preferably formed of two articles of stamped metal, which simplifies and reduces the cost of manufacture.

Referring to FIGS. 1–4, regarding operation of the burner, to produce a shaped flame from the burner nozzle, combustible gas is fed into the gas opening 38 of the burner tube 18 from a gas valve (not shown) in a manner known to those skilled in the art. Air is entrained by the gas into the burner tube through the air supply openings 40. The flow of gas and air is directed into the burner tube 18 that extends along the central axis C. The air and gas is mixed in the burner tube venturi and is directed along the central axis C toward the outlet end portion 47 of the burner tube 18. The mixture of gas and air reaches the curved head 30 of the burner nozzle 10 and a portion of the mixture is diverted by the imperforate portion 36 of the curved head away from the central axis C. A portion of the gas and air passes through the central opening 37 and the remainder of the gas and air mixture is passed through the plurality of openings 32 in a direction transverse to the central axis C. The mixture of gas and air is then ignited to produce a shaped flame, such as that shown in FIG. 4.

Referring to FIG. 4, the shape of the flame 80 formed by the burner nozzle of the exemplary embodiment is relatively short and wide. A portion of the mixture of gas and air exits the plurality of openings 32 transverse to the central axis C and is ignited to produce a wide flame portion 82. The shape of the wide portion 82 resembles petals of a flower that extend from a center of the flower. A central flame portion 84 is produced by igniting the portion of the mixture of gas and air that exits the burner nozzle 10 through the central hole 37. The length and width of the flame 80 can be adjusted by varying the size of the central hole 37. The length of the flame is increased and the width of the flame is reduced by increasing the size of the central hole. The flame 80 is shortened and the width of the flame is increased by reducing the size of the central hole 37.

Although the invention has been described in its preferred form with a certain degree of particularity, it will be understood that the present disclosure of the preferred embodiments has been made only by way of example and that various changes may be resorted to without departing from the true spirit and scope of the invention as hereafter claimed.

We claim:

1. A burner nozzle for producing a shaped flame for efficient heat transfer, comprising:

a burner tube that extends along a central axis, including an inlet end portion for receiving combustible gas and air and an outlet end portion for releasing a mixture of said gas and said air, said outlet end portion includes a head mounting recess; and a curved head in communication with said outlet end portion, said curved head including a transversely extending mounting flange, said mounting flange being constrained within said head mounting recess, said head having a plurality of openings and an imperforate portion surrounding said central axis, said plurality of openings comprise a first row of openings circumferetially spaced about a circumference of said head and a second row of openings circumferentially spaced about said circumference of said head between said first row of openings and a tip of said burner located at said central axis wherein said openings and said imperforate portion create a transverse flow of said mixture out of said head to produce a shaped flame.

2. A burner nozzle for producing a shaped flame for efficient heat transfer, comprising:

a burner tube that extends along a central axis, including an inlet end portion for receiving combustible gas and air and an outlet end portion for releasing a mixture of said gas and said air, said outlet end portion includes a head mounting recess; and a curved head in communication with said outlet end portion, said curved head including a transversely extending mounting flange, said mounting flange being constrained within said head mounting recess, said head having a plurality of openings, a central opening that encompasses said central axis, and an imperforate portion surrounding said central axis, wherein said imperforate portion is defined by an area between said central opening and said plurality of opening, said plurality of openings and said imperforate portion create a transverse flow of said mixture out of said head to produce a shaped flame.

3. A burner nozzle for producing a shaped flame for efficient heat transfer, comprising:

a burner tube that extends along a central axis, including an inlet end portion for receiving combustible gas and air and an outlet end portion for releasing a mixture of said gas and air, said outlet end portion includes a head mounting recess; and a hemispherical head having a transversely extending mounting flange constrained within said head mounting recess to connect said head to said tube, said hemispherical head having a plurality of openings and an imperforate portion surrounding said central axis, said openings being circumferentially spaced about a circumference of said hemispherical head to create a transverse flow of said mixture out of said head to produce a shaped flame.

4. The burner nozzle of claim 3 wherein said openings are circular.

5. The burner nozzle of claim 3 comprising a central opening that encompasses said central axis, wherein said imperforate portion is defined by an area between said central opening and said plurality of openings.

6. A method of producing a shaped flame from a burner nozzle, comprising the steps of:

directing combustible gas and air into an inlet end portion of a burner tube that extends along a central axis;

mixing said gas and said air in said burner tube to create a mixture of gas and air;

directing said gas and said air along the central axis toward an outlet end portion of said burner tube having a head mounting recess;

deflecting a portion of said gas and said air by contact with an imperforate portion of a head having a hemispherical shaped portion and a mounting flange that is constrained within said head mounting recess to divert a portion of said gas and said air away from said central axis;

passing said gas and said air through circumferentially spaced openings in said head; and igniting said mixture to produce a shaped flame.

7. The method of claim 6 wherein said step of passing said gas and said air through said head directs a portion of said gas and said air in a direction that is transverse to said central axis.

8. A burner nozzle for producing a shaped flame for efficient heat transfer, comprising:

a burner tube that extends along a central axis, including an inlet end portion for receiving combustible gas and air and an outlet end portion for releasing a mixture of said gas and said air;

wing portions extending laterally from said burner tube; and a curved head in communication with said outlet end portion, said curved head having a plurality of openings and an imperforate portion surrounding said central axis, wherein said openings and said imperforate portion create a transverse flow of said mixture out of said head to produce a shaped flame.

9. The burner nozzle of claim 8 wherein said head comprises a curved portion and a cylindrical portion, said head being curved from a tip of said head to said cylindrical portion.

10. A burner nozzle for producing a shaped flame for efficient heat transfer, comprising:

a burner tube that extends along a central axis, including an inlet end portion for receiving combustible gas and air and an outlet end portion for releasing a mixture of said gas and said air; and a curved head including a curved portion defined by a portion of a sphere, a cylindrical portion extending from said curved portion and a mounting flange extending transversely from said curved portion said mounting flange being connected to said outlet end portion to connect said curved head to said burner tube, said curved head having a plurality of openings and an imperforate portion surrounding said central axis, wherein said openings and said imperforate portion create a transverse flow of said mixture out of said head to produce a shaped flame.

11. The burner nozzle of claim 10 wherein said head is curved from a tip of said head to said cylindrical portion.

12. A burner nozzle for producing a shaped flame for efficient heat transfer, comprising:

a burner tube that extends along a central axis, including an inlet end portion for receiving combustible gas and air and an outlet end portion for releasing a mixture of said gas and air; and a hemispherical head in communication with said outlet end portion, said hemispherical head having a plurality of openings and an imperforate portion surrounding said central axis, said openings comprise a first row of openings evenly spaced about the circumference of said head and a second row of smaller openings evenly spaced about the circumference of said head between said first row of openings and a tip of said burner located at said central axis to create a transverse flow of said mixture out of said head to produce a shaped flame.

13. A burner nozzle for producing a shaped flame for efficient heat transfer, comprising:

a burner tube that extends along a central axis, including an inlet end portion for receiving combustible gas and air and an outlet end portion for releasing a mixture of said gas and air; and a hemispherical head comprising a hemispherical portion, a cylindrical portion extending from said hemispherical portion and a mounting flange extending transversely from said cylindrical portion connected to said outlet end portion to connect said head to said tube, said head having a plurality of openings and an imperforate portion surrounding said central axis, said openings being circumferentially spaced about a circumference of said hemispherical head to create a transverse flow of said mixture out of said head to produce a shaped flame.

14. The burner nozzle of claim 13 wherein said mounting flange is captured by a mounting cavity in said burner tube.

15. A burner assembly for producing a shaped flame for efficient heat transfer, comprising:

a combustion tube surrounding an interior region;

a burner nozzle disposed in said interior region and connected to said combustion tube, said burner nozzle comprising a burner tube that extends along a central axis, including an inlet end portion for receiving combustible gas and air and an outlet end portion for releasing a mixture of said gas and said air; and a curved head in communication with said outlet end portion, said curved head having a plurality of circumferential openings, a central opening that encompasses said central axis, and an imperforate portion surrounding said central axis, wherein said imperforate portion is defined by an area between said central opening and said plurality of openings, said circumferential openings create a transverse flow of said mixture out of said head to produce a shaped flame.

16. A burner assembly for producing a shaped flame for efficient heat transfer, comprising:

a combustion tube surrounding an interior region;

a burner nozzle disposed in said interior region and connected to said combustion tube, said burner nozzle comprising a burner tube that extends along a central axis and a wing portion, said burner tube including an inlet end portion for receiving combustible gas and air and an outlet end portion for releasing a mixture of said gas and said air, said mixture of gas and air is prevented from exiting through said wing portion; and a curved head in communication with said outlet end portion, said curved head having a plurality of openings and an imperforate portion surrounding said central axis, said openings create a transverse flow of said mixture out of said head to produce a shaped flame.

17. A method of producing a shaped flame from a burner nozzle, comprising the steps of:

directing combustible gas and air into an inlet end portion of a burner tube that extends along a central axis;

mixing said gas and said air in said burner tube;

directing said gas and said air along the central axis toward an outlet end portion of said burner tube;

deflecting a first portion of said gas and said air by contact with an imperforate portion of a curved shaped head at said outlet end portion to divert a portion of said gas and said air away from said central axis;

passing a second portion of said mixture of gas and air through a central opening in said curved head that encompasses said central axis to elongate a shaped flame;

passing a third portion of said gas and said air through circumferentially spaced openings in said curved head; and igniting said mixture to produce said shaped flame.

18. A method of producing a shaped flame from a burner nozzle, comprising the steps of:

selecting a curved shaped head from a series of curved shaped heads for use in said burner nozzle, said series of heads having central openings with varying diameters to thereby adjust a length of a shaped flame based on the diameter of the central opening of said selected head;

directing combustible gas and air into an inlet end portion of a burner tube that extends along a central axis;

mixing said gas and said air in said burner tube;

directing said gas and said air along the central axis toward an outlet end portion of said burner tube;

deflecting a portion of said gas and said air by contact with an imperforate portion of a curved shaped head at said outlet end portion to divert a portion of said gas and said air away from said central axis;

passing said gas and said air through circumferentially spaced openings in said curved head; and igniting said mixture to produce said shaped flame.

19. A burner nozzle for producing a shaped flame, comprising:

a burner tube that extends along a central axis, including an inlet end portion for receiving combustible gas and air and an outlet end portion for releasing a mixture of said gas and air; and a curved head comprising a curved portion, a cylindrical portion extending from said curved portion and a mounting flange extending transversely from said cylindrical portion connected to said outlet end portion to connect said head to said burner tube.

20. The burner nozzle of claim 19 wherein said burner tube includes a head mounting recess that defines a cavity that accepts said mounting flange.

21. The burner nozzle of claim 19 wherein said burner tube includes a first transition where the inlet end of the burner tube is reduced to an inner diameter of the burner tube and a second transition where the inner diameter is increased to the outlet end portion.

* * * * *